US006655087B2

(12) United States Patent
Andersen

(10) Patent No.: US 6,655,087 B2
(45) Date of Patent: Dec. 2, 2003

(54) SAFETY BARRIER, SUCH AS FOR CHILDREN OR PETS, HAVING AN EXTENSION SECTION

(75) Inventor: Jesper Andersen, Låsby (DK)

(73) Assignee: Baby Dan A/S, Laasby (DK)

( * ) Notice: Subject to any disclaimer, the term of this patent is extended or adjusted under 35 U.S.C. 154(b) by 0 days.

(21) Appl. No.: 09/809,039

(22) Filed: Mar. 16, 2001

(65) Prior Publication Data

US 2002/0157316 A1 Oct. 31, 2002

(30) Foreign Application Priority Data

Mar. 16, 2000 (DK) ..... 2000 00436

(51) Int. Cl.[7] ..... E06B 3/68
(52) U.S. Cl. ..... 49/55; 49/57
(58) Field of Search ..... 49/55, 56, 57, 49/463, 465, 501, 50, 505, 74.1

(56) References Cited

U.S. PATENT DOCUMENTS 4,026,070 A * 5/1977 Hicks ..... 49/55
4,583,715 A * 4/1986 Wright ..... 256/24
4,611,431 A * 9/1986 Lauro ..... 49/55
4,685,247 A * 8/1987 Alam ..... 49/55
4,850,144 A * 7/1989 Grisham et al. ..... 49/501
5,396,732 A * 3/1995 Andersen ..... 49/55
5,442,881 A * 8/1995 Asbach et al. ..... 49/465
5,555,923 A * 9/1996 Leist et al. ..... 49/501
5,809,694 A * 9/1998 Postans ..... 49/57
5,845,439 A * 12/1998 Hendley ..... 49/505
5,890,320 A * 4/1999 Andersen ..... 49/465
6,112,461 A * 9/2000 Cheng ..... 49/55
6,125,581 A * 10/2000 Grossman ..... 49/74.1
6,176,042 B1 * 1/2001 Rossman et al. ..... 49/463
6,253,490 B1 * 7/2001 Postans ..... 49/55
6,301,832 B1 * 10/2001 Andersen ..... 49/57
6,308,462 B1 * 10/2001 Andersen ..... 49/57

FOREIGN PATENT DOCUMENTS

GB 2219026 * 11/1989
WO 9307352 4/1993

* cited by examiner

*Primary Examiner*—Jerry Redman
(74) *Attorney, Agent, or Firm*—Dykema Gossett PLLC

(57) ABSTRACT

Extension assemblies for connection to one or both ends of a safety barrier to increase its width include top and bottom elements, each having a horizontal channel therethrough, a vertical connection element extending therebetween, and assembly elements which extend through the respective horizontal channels and into aligned holes in the barrier to resist lateral forces.

6 Claims, 4 Drawing Sheets

SAFETY BARRIER, SUCH AS FOR CHILDREN OR PETS, HAVING AN EXTENSION SECTION

BACKGROUND OF THE INVENTION

1. The Field of the Invention

The invention relates to safety barriers, such as for children or pets, which can be removably secured in apertures in buildings, e.g., in doorways, staircases and windows.

2. The Prior Art

To adapt safety barriers to fit specific apertures, it is known to equip such gates with threaded rods or similar devices in the corner, see, e.g., U.S. Pat. No. 5,396,732. Using lock nuts, these threaded rods can then be adjusted so the safety barrier can be fitted and secured in the aperture in question. Threaded rods make it possible to vary the width of the gate within a limited interval. However, for security reasons the distance between the surroundings of the aperture such as a doorframe and the safety barrier must not be too large, i.e., such that a child can squeeze its head through the passage. Moreover, a long unsupported threaded rod is not sufficiently rigid. This means that several standard gate widths are needed. One of the disadvantages of adjusting safety barriers using threaded rods is that the amount of adjustment possible is very limited.

To obtain a larger adjustment, extension sections of different widths are used. The extension sections have studs which fit into the holes used for the threaded rods. The threaded rods are then mounted at the end of the extension section facing the wall or frame. The benefit is that a standard barrier can be used. This however requires stocking of extension sections of different widths. Placing such extension sections in continuation of each other renders the barrier unstable, since the addition of each new extension section results in an additional junction point, making the barrier increasingly unstable.

A different type of barrier is known which includes two parts displaced in relation to each other. The two parts are each longer than half the width of the passage and are assembled with overlying ends. Further, such barriers do not have their own frame, and are designed for attachment to a door frame or wall using screws or similar attachment systems.

SUMMARY OF THE INVENTION

The object of the invention is to provide a safety barrier that can be adjusted in width within a large interval but with a minimum of junction points. At the same time, the safety barrier must retain the necessary rigidity and resistance to impact in sideways (lateral) directions.

The object of the invention is achieved by providing that the extension section is formed of at least one unit having at its top and bottom a longitudinal aperture or channel to accommodate top and bottom assembly devices that respectively extend all the way through each of the units.

By means of the units, various lengths of extension section, or widths of the provided safety barrier, can be achieved using assembly devices of a corresponding length. As the assembly devices extend all the way through the units, the extension section becomes very rigid. Making the units identical reduces the need for stockpiling of parts even further, but they could also be different to achieve a special appearance of the barrier.

In one embodiment the length of the assembly devices may be less than the width of the number of extension units in question. The result is that the extension units are jammed between the securing means and the barrier itself. In other words, the securing means sits tight against the outermost extension unit so that the extension units are fixed in position and cannot be moved.

In a further embodiment the length of the assembly devices are longer than the width of the number of extension units in question. This ensures that the axial force on the top and bottom elements, when the barrier is secured in the aperture, is transmitted directly to the assembly devices. This is the best mode of ensuring correct attachment.

The safety barrier with extension sections can be fitted with a control pin on one closing surface by the gate locking mechanism, with a hole designed to accommodate this control pin on the opposite closing surface. This control pin helps to increase the rigidity and resistance of the gate to impact at right angles.

The assembly devices can be designed to ensure that standard securing devices to secure the barrier fit therein. Designing the assembly devices in this way means that the standard fitting that normally belongs to the barrier in question can also be used if extension sections need to be mounted on the barrier.

BRIEF DESCRIPTION OF THE DRAWINGS

The invention will be explained in detail by reference to the accompanying drawings, which show a preferred embodiment of the invention.

In the figures.

DETAILED DESCRIPTION OF THE PREFERRED EMBODIMENT

Figure 1:
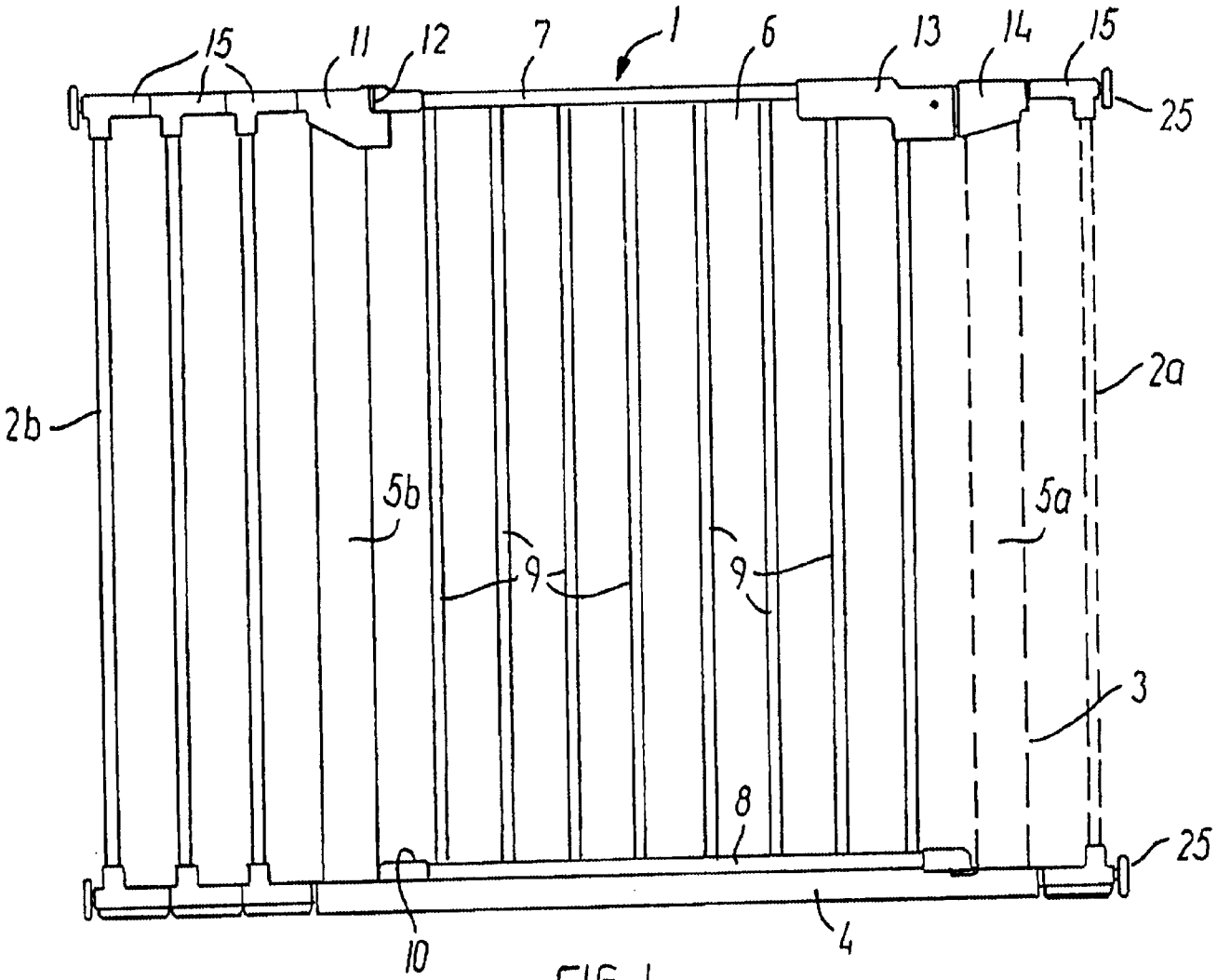
FIG. 1 shows a fully mounted safety barrier with extension sections.
Figure 2:
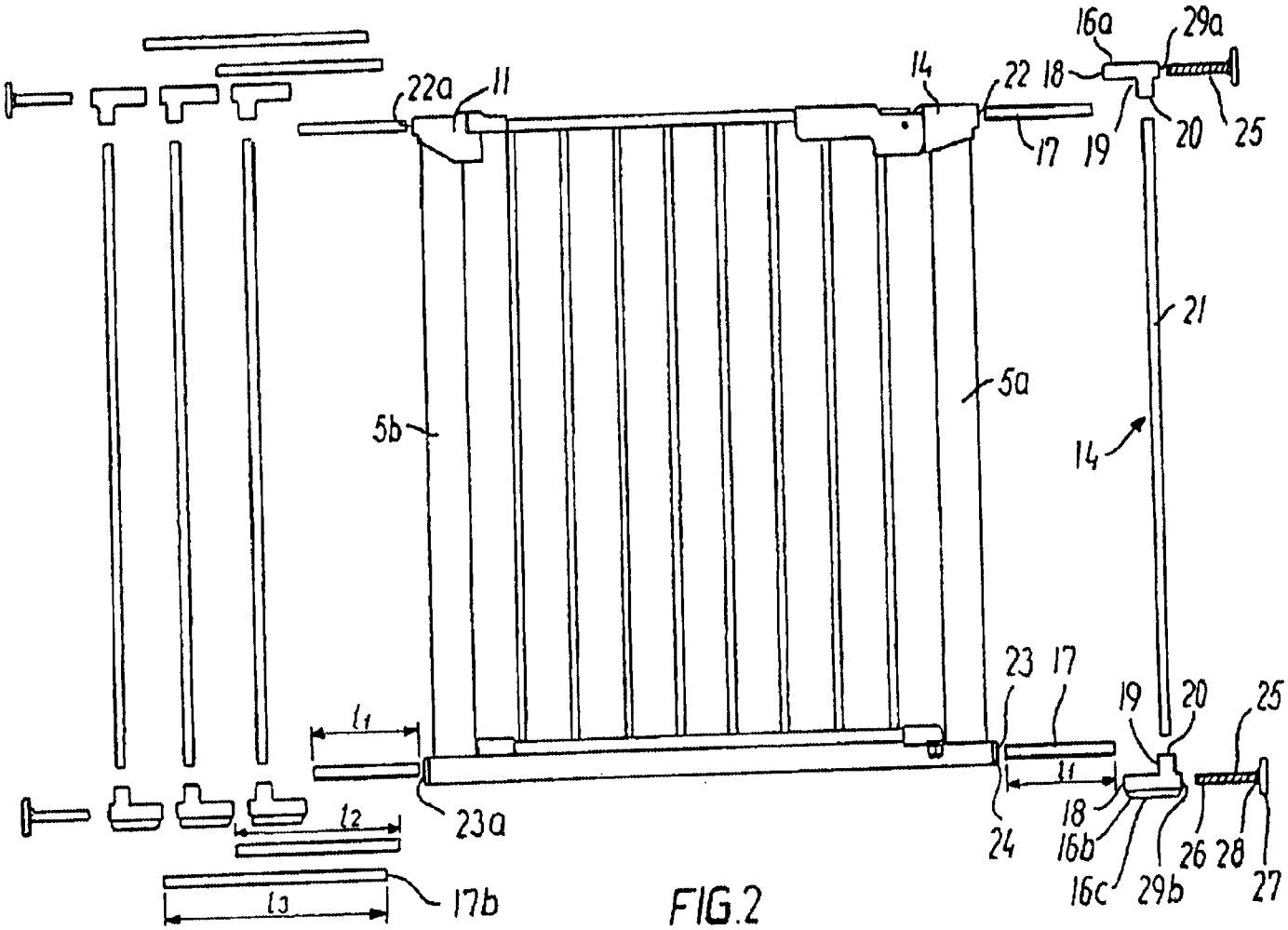
FIG. 2 shows the same barrier before assembly.

The safety barrier shown in FIGS. 1 and 2 is formed of two main elements, namely a standard barrier 1 and extension sections 2*a* and 2*b* at opposite sides thereof.

The standard barrier includes a rigid U-shaped frame 3 having a horizontally-extending beam 4 and at either ends thereof vertically-extending pillars 5*a* and 5*b*. Further, the standard barrier includes an openable gate 6 which includes parallel upper and lower horizontal bars 7 and 8. A plurality of spaced, vertically-extending rods 9 are disposed between the upper and the lower horizontal bars 7 and 8. The gate at one side is hinged to the U-frame 3, one end of the lower horizontal bar 8 being hinged at 10 to the upwardly-facing side of the horizontal beam 4 of the frame 3 and the corresponding end of the upper horizontal bar 7 being hinged at 12 to a cap element 11 rigidly secured to the top of the neighboring pillar 5*b*. The opposite top corner of the gate 6 is furnished with a locking mechanism 13 cooperating with a cap element 14 on the top of the respective pillar 5*a*. The horizontally-extending beam 4 preferably has a rectangular cross section placed edgeways. The pillars 5*a* and 5*b* also have a rectangular cross section, the width of which corresponds with the width of the beam 4, and are welded or soldered thereto. The horizontal bars 7 and 8 of the gate 6 have a square cross section and the bars 9 have a circular cross section. The locking mechanism 13 and the hinges 10 and 12 are not further described as they are not part of the present invention; however, further information as to the nature of these parts can be found in U.S. Pat. No. 5,396,732.

Extension sections 2*a* and 2*b* of different lengths can be made from one or more units 15 formed of a top element 16*a*, a bottom element 16*b*, a connection member 21, and two identical assembly devices 17. The top and bottom elements 16*a* and 16*b* have horizontal through holes 18 into which the respective assembly element in the form of a length of pipe can be inserted. Further, the top and bottom elements 16*a* and 16*b* each have a vertically-extending sleeve 19 with a hole 20 for accommodation of the adjacent end of a vertically-extending member or rod 21 identical to the rods 9 in the gate. The end of the rod 21 is tightly retained in the sleeves 19. Alternatively, the sleeves can be replaced by knobs and the ends of the rod, which can be hollow, can be pressed over them. The length of the rod 21 is such that the top and the bottom elements 16*a* and 16*b* will be in alignment with the upper rod 7 of the gate 6 and the lower horizontal bar 4 of the U-shaped frame, respectively. The bottom element 16*b* includes a downwardly-extending rib 16*c* whose lower edge is flush with the bottom of the horizontal beam 4.

The right hand side of the barrier 1 is furnished with an extension section 2*a* formed of one unit 15. The unit is placed against the barrier and an assembly device 17 is inserted into the top element 16*a* and pushed forward into a hole 22 in the cap 14 of the pillar 5*a*, this hole 22 being designed to receive the end of the assembly device 17 in a snug fitting manner. The length of the assembly device 17 is measured such that it terminates at the outer end of the hole 18 in the top element 16*a* and does not protrude from the element. The bottom element 16*b* is attached to the barrier 1 in a similar manner, the assembly device 17 entering a hole 23 in a plug 24 inserted into the end of the horizontal beam 4, which is hollow. The assembly element can be in the form of a rod, bar or length of pipe, and preferably has a square or rectangular cross section to prevent rotation of the elements through which it extends.

A securing means 25 can be inserted into the ends of the assembly device 17 for securing the barrier with extension sections in a doorway, staircase or the like aperture. The securing means 25 includes a threaded rod 26 bearing a foot member 27 at the outer end and a lock nut 28. The end of the threaded rod 26 can be inserted into the assembly device 17 and the lock nut 28 can be tightened against the front 29*a*, 29*b* of the top and bottom elements, respectively. The securing means is described in further detail in U.S. Pat. No. 5,396,732.

Figure 3:
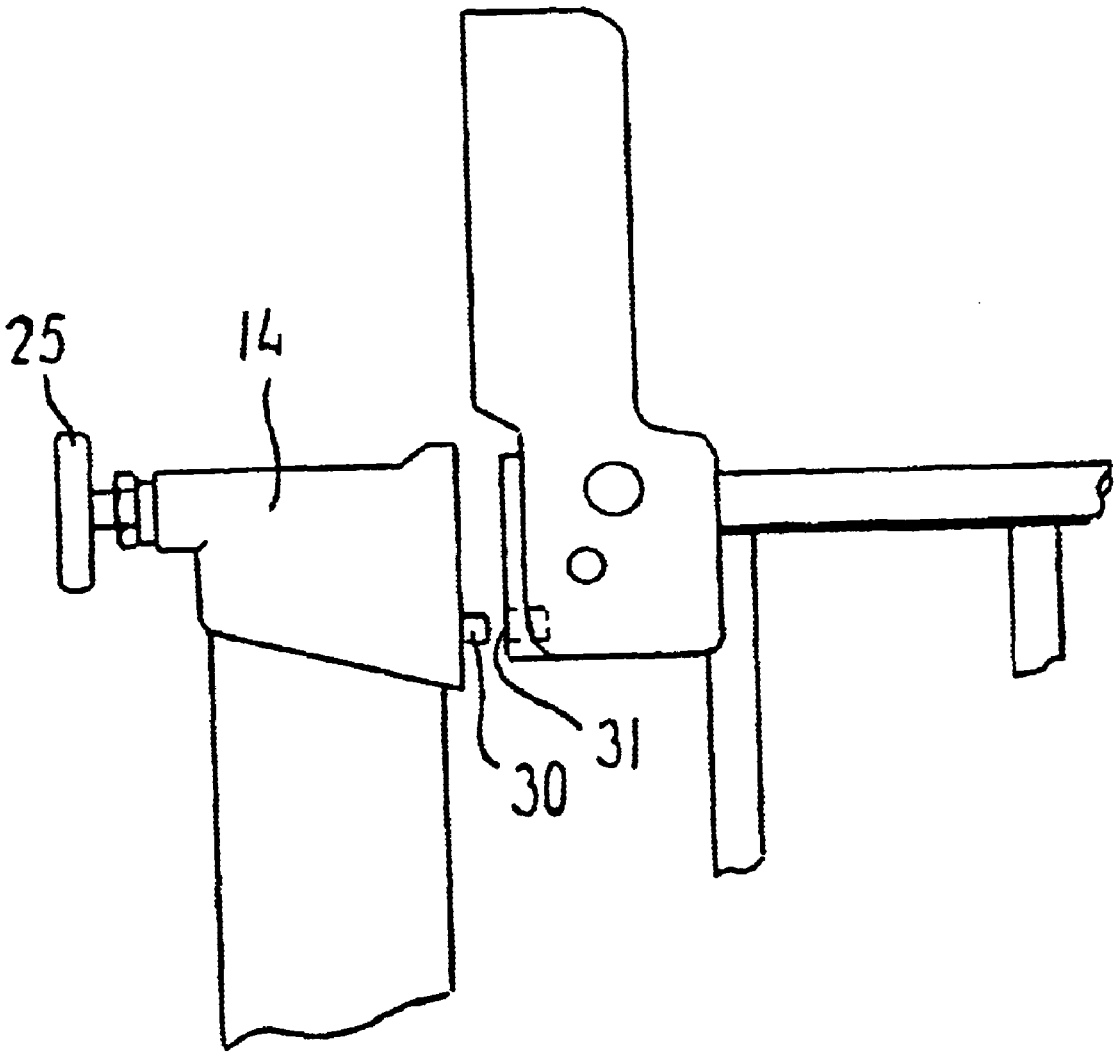
FIG. 3 is an enlarged detailed view of the locking mechanism
Figure 4:
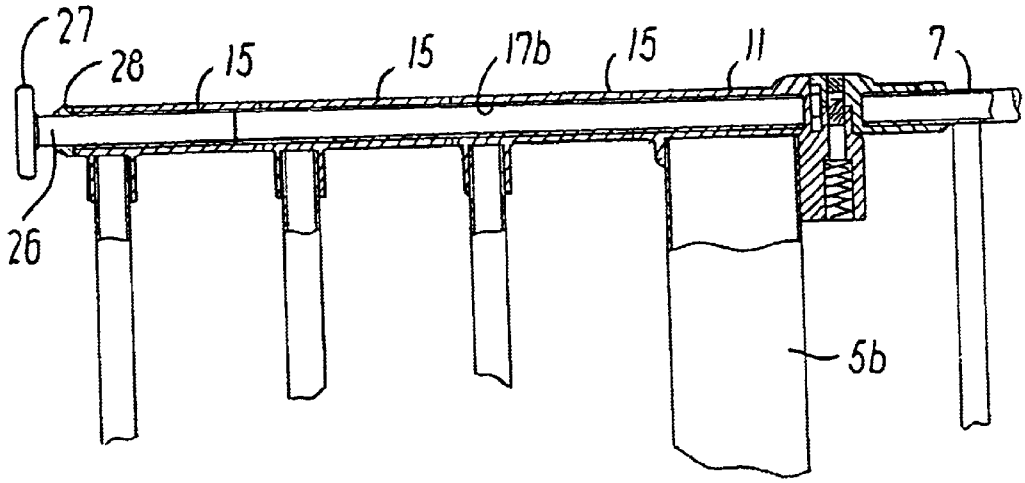
FIG. 4 is an enlarged detailed view of the upper part of the extension section to the left in FIG. 1.
Figure 5:
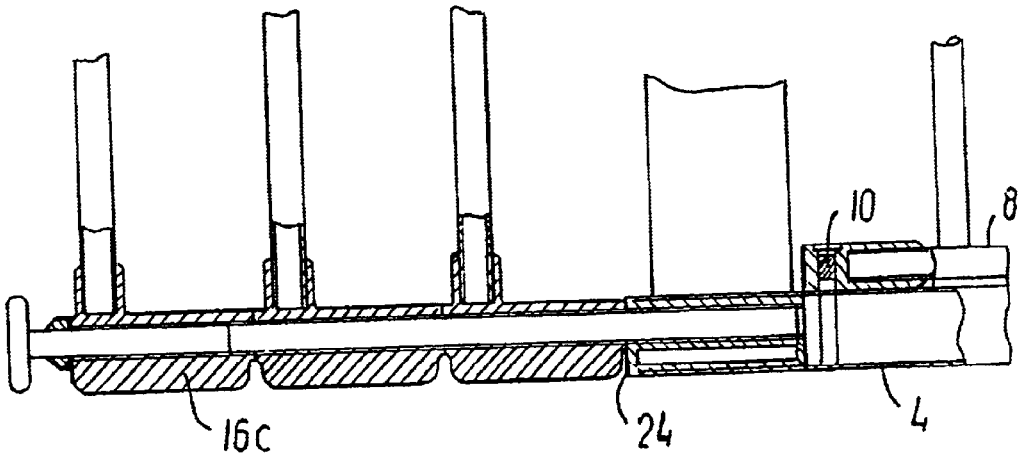
FIG. 5 is an enlarged detailed view of the lower part of the extension section to the left in FIG. 1.

It should be noted that the securing means 25 also can be used directly in connection with the standard barrier 1 as the securing means fits into holes 22 and 23 in the cap 14 on the pillar 5*a* and the horizontal beam 4, respectively, see FIG. 3.

The other side of the standard barrier 1 (see FIGS. 1, 2, 4 and 5) is furnished with an extension section 2*b* formed of three units 15. The assembly devices 17*b* have a length 13 measured such that they extend through all three units. The ends of the assembly devices 17*b* are like before respectively accommodated in a hole 22*a* in the cap 11 at the pillar 5*b* at the hinge side of the gate 6 and a hole 23*a* at the end of the horizontal beam 4 of the frame. The assembly device 17 is accommodated in the holes in a snug, tight-fitting manner as described before.

It should be understood that the assembly devices 17 are available in various lengths $l_1$, $l_2$, $l_3$ matching a specific number of extension units 15 depending on the width of the extension section 2*a* and 2*b* required. Using assembly devices 17 which as one piece extend through the units 15 makes the extension section very rigid and can resist perpendicular (lateral) loads on the sides of the barrier or the extension section itself without lateral deflection which otherwise would make the securing means 25 loosen their contact with the surrounding aperture.

FIG. 3 shows details of the locking mechanism. The surface of the cap 14 facing the gate 1 is equipped with a control pin 30 that fits a hole 31 in part of the locking mechanism on the gate. This control pin 30, together with assembly devices 17 and the securing means 25, hinge 12 and locking mechanism 13, provides a safety barrier 1 having extension sections 2*a* and 2*b* with optimum rigidity.

It should be understood that the present invention is not limited to the specific barrier shown in the drawings. For example, the element 21 could be in the form of a panel interconnecting the top and bottom elements 16*a* and 16*b*. The barrier could also be of the type shown in U.S. Pat. No. 5,396,732 having the openable gate at one side thereof.

I claim:

1. A safety barrier which is positionable in an opening between two supports, said barrier comprising:

a frame including a lower horizontally-extending base member and spaced first and second vertical pillars attached thereto, an openable gate positioned between said first and second pillars and pivotally connected at one end to said first pillar so as to move between a closed and open state, and a plurality of extension assemblies which are aligned with one another and with the frame to increase a width of said barrier, each of said extension assemblies including a tope element having a horizontal channel therethrough, a bottom element having a horizontal channel therethrough, and a connection element extending between said top and bottom elements, and first and second elongated assembly elements which are sufficiently long to respectively simultaneously extend through said channels in said top and bottom elements of all of said plurality of extension assemblies and into aligned openings in one of said first and second pillars, said first and second elongated assembly elements providing lateral rigidity to the frame and said plurality of extension assemblies attached thereto.

2. A safety barrier according to claim 1, wherein said first assembly element device comprises a rod, bar or pipe.

3. A safety barrier according to claim 2, wherein said first assembly element has a rectangular cross section.

4. A safety barrier according to claim 1, wherein each of said top and bottom elements includes a horizontal portion having said horizontal channel therethrough and a vertical sleeve portion for seating an adjacent end of a respective connection element.

5. A safety barrier according to claim 1, wherein said bottom elements include downwardly-extending ribs which are flush with said lower horizontally-extending base member of said frame.

6. A safety barrier according to claim 1, wherein said gate includes a closing mechanism at a second end thereof, said closing mechanism including a hole, and wherein an adjacent first top element includes a control pin for insertion in said hole to increase lateral rigidity of said safety barrier.

* * * * *